US008878629B2

(12) United States Patent
Gehring et al.

(10) Patent No.: US 8,878,629 B2
(45) Date of Patent: Nov. 4, 2014

(54) DIPLEXER FOR A REFLECTOR ANTENNA

(75) Inventors: Ralf Gehring, Feldkirchen (DE); Christian Hartwanger, Munich (DE); Un Pyo Hong, Ottobrunn (DE); Enrico Reiche, Glonn (DE); Michael Schneider, Neubiberg (DE); Ernst Sommer, Wolfratshausen (DE); Helmut Wolf, Holzkirchen (DE)

(73) Assignee: Astrium GmbH, Taufkirchen (DE)

( * ) Notice: Subject to any disclaimer, the term of this patent is extended or adjusted under 35 U.S.C. 154(b) by 544 days.

(21) Appl. No.: 13/039,665

(22) Filed: Mar. 3, 2011

(65) Prior Publication Data

US 2011/0254640 A1 Oct. 20, 2011

(30) Foreign Application Priority Data

Mar. 4, 2010 (DE) ..... 10 2010 010 299

(51) Int. Cl.

| | |
|---|---|
| ***H01P 1/213*** | (2006.01) |
| ***H01P 1/161*** | (2006.01) |
| ***H01Q 15/24*** | (2006.01) |
| ***H01P 1/162*** | (2006.01) |

(52) U.S. Cl.

CPC ..... *H01P 1/2133* (2013.01); *H01P 1/2138* (2013.01); *H01P 1/162* (2013.01)

USPC ..... 333/135; 333/21 A; 333/117; 343/756

(58) Field of Classification Search

CPC ..... H01P 1/2138; H01P 1/161; H01Q 15/244

USPC ..... 333/21 A, 21 R, 122, 126, 135, 137, 208; 343/756, 786, 776

See application file for complete search history.

(56) References Cited

U.S. PATENT DOCUMENTS 3,500,258 A 3/1970 Nagelberg
3,618,106 A * 11/1971 Bryant ..... 343/742

(Continued)

FOREIGN PATENT DOCUMENTS

DE 10 2008 044 895 A1 3/2010
EP 0 443 526 A1 8/1991

(Continued)

OTHER PUBLICATIONS

T. S. Bird, G. L. James, and S.J. Skinner, "Input Mismatch of TE11 Mode Cooaxial Waveguide Feeds", IEEE Trans. on Antennas and Propagation, vol. AP-34, No. 8, Aug. 1986, pp. 1030-1033.*

Robert L. Eisenhart, "A Novel Wideband TM01-to-TE11 Mode Convertor", TU3E-5, 1998, pp. 249-252, IEEE MTT-S Digest, Eisenhart & Associates, CA.

(Continued)

*Primary Examiner* — Benny Lee
*Assistant Examiner* — Rakesh Patel
(74) *Attorney, Agent, or Firm* — Crowell & Moring LLP

(57) ABSTRACT

A diplexer for a reflector antenna includes a common circular signal waveguide to transmit and receive signals. The signal waveguide includes first and second ends with a common port provided at the first end. A waveguide arrangement is disposed coaxially relative to the signal waveguide in the region of the second end of the signal waveguide. A cylindrical coupler section is disposed between the first and second ends of the signal waveguide, and connects the waveguide arrangement to the common signal waveguide. In order to create a first and second coaxial waveguide port, the waveguide arrangement includes a first circular waveguide, an inner conductor is disposed inside, in which a first signal can propagate when the diplexer is operating, and a second circular waveguide, surrounding the first waveguide, in which a second signal can propagate at a lower frequency than the first signal when the diplexer is operating.

15 Claims, 6 Drawing Sheets

(56) References Cited

U.S. PATENT DOCUMENTS

| | | | | |
|---|---|---|---|---|
| 3,922,621 | A | 11/1975 | Gruner | |
| 4,725,795 | A * | 2/1988 | Ajioka et al. | 333/126 |
| 5,399,999 | A | 3/1995 | Eisenhart | |
| 6,329,957 | B1 | 12/2001 | Shea et al. | |
| 6,937,202 | B2 | 8/2005 | Chandler | |
| 8,198,955 | B2 | 6/2012 | Reiche et al. | |
| 2003/0222733 | A1 | 12/2003 | Ergene et al. | |
| 2009/0251233 | A1 | 10/2009 | Mahon et al. | |

FOREIGN PATENT DOCUMENTS

| | | | |
|---|---|---|---|
| EP | 1 369 955 | A2 | 12/2003 |
| JP | 5-83012 | A | 4/1993 |

OTHER PUBLICATIONS

European Search Report with partial English translation dated Jun. 28, 2011 (eight (8) pages).

European Office Action dated Apr. 9, 2013 (two (2) pages).

* cited by examiner

DIPLEXER FOR A REFLECTOR ANTENNA

CROSS REFERENCE TO RELATED APPLICATIONS

This application claims priority under 35 U.S.C. §119 to German Patent Application No. 10 2010 010 299.7-55, filed Mar. 4, 2010, the entire disclosure of which is herein expressly incorporated by reference.

BACKGROUND AND SUMMARY OF THE INVENTION

The invention relates to a diplexer for a reflector antenna for transmitting microwave signals. The invention furthermore relates to a method for processing a received signal stored that has been fed into a diplexer.

Due to their very narrow radiation pattern, large reflector antennas require very precise alignment relative to a transmitter and/or receiver, more generally, to a remote station. A beacon signal emitted by the remote station is typically used for alignment. An antenna diagram with a null in the main beam direction is required to allow the beacon signal to be evaluated by the reflector antenna, or by an evaluation unit coupled to the reflector antenna. Whenever the beacon signal deviates from the main beam direction, an additional signal is received that can be used to correct the deviation in direction. The transmission, separation, and evaluation of the beacon signal are effected in addition to the transmission of the actual communication signal. In doing so, the beacon signal must not affect the actual communication signal.

A reflector antenna for transmitting microwave signals typically comprises a diplexer that has a common signal waveguide to transmit a transmit signal and a receive signal. The common signal waveguide comprises a first end and a second end. A horn is connected to the first end of the common signal waveguide, through which a coupling out of the transmit signal and a coupling in of the transmit signal from/into the common signal waveguide are effected. Generally, a plurality of waveguide ports are coupled to the common signal waveguide for the purpose of feeding in the transmit signal into the diplexer and to couple out the receive signal from the diplexer into a receiver network. The waveguide ports are, e.g., distributed symmetrically along the outside of the common signal waveguide, each being in communicative connection with the common signal waveguide.

The particular function of the diplexer is to process a mode mixture of modes from the receive signal in such a way that a differentiation is possible between the actual communication signal and the correction data for the communication signal. At the same time, the diplexer must correctly transmit a transmit signal fed into the plurality of signal waveguides to be coupled out through the horn. Until now, the existing conflict of objectives here has not been satisfactorily solved whereby both of the receive signals must be correctly divided in terms of its communication signal and the correction information, while the transmit signal must be coupled out with the desired polarization from the reflector antenna.

U.S. Pat. No. 3,922,621 discloses a coaxial diplexer for a reflector antenna for the purpose of transmitting microwave signals. The diplexer comprises a first circular waveguide in which a first signal can propagate. It also comprises a second circular waveguide in which a second signal can propagate that is of lower frequency than the first signal, the second waveguide surrounding the first waveguide. One section of the second waveguide is designed as a corrugated waveguide that has a plurality of annular corrugations extending circumferentially in annular fashion. This effectively decouples the transmit signal and receive signal. However, with the diplexer of U.S. Pat. No. 3,922,621 no propagation of a tracking signal is possible by which a correction of the directional deviation of the reflector antenna is able to be determined.

A non-published German patent application DE 10 2008 004 895.8 reveals a signal junction comprising a signal waveguide for the transmission of a transmit signal and a receive signal. A plurality of transmit signal waveguides are provided to feed in the transmit signal, where the signal waveguides are symmetrically arranged along the outside of the common signal waveguide and are in communicative connection with the common signal waveguide. Similarly, a plurality of receive signal waveguides are provided to transmit the receive signal, where the receive signal waveguide is symmetrically connected to the common signal conductor and is also in communicative connection with the common signal waveguide. Incorporation of filters in the receive signal waveguide is required in order to be able to acquire a tracking signal.

U.S. Pat. No. 6,937,202 B2 discloses an approach whereby modes are separated by reducing the horn diameter below a critical diameter. This is called a virtual short circuit. It is not possible to effect a common coupling out of receive signal (from the point of view of the satellite) and tracking signal along with simultaneously isolating the transmit signal. In order to do this, filters are required in the side arms.

U.S. Patent Application Publication No. 2003/0222733 A1 discloses the separation of modes by reducing the horn diameter below the critical diameter using a virtual short circuit. It is not possible to effect a common coupling out of receive signal (from the point of view of the satellite) and tracking signal along with simultaneously isolating the transmit signal. The disclosure relates to ground station applications where the provided structure of the feed system can be used due to the reversed assignment of transmit and receive bands. Filters are absolutely essential in the side arms.

Exemplary embodiments of the present invention provide a diplexer for a reflector antenna that transmits microwave signals, the diplexer providing improved correction of the directional deviation of the reflector antenna. Exemplary embodiments of the present invention also provide a method for processing a receive signal fed into a diplexer, the method providing improved precision in correcting the directional deviation.

Exemplary embodiments of the invention provide a diplexer for a reflector antenna for transmitting microwave signals. The diplexer comprises a common circular signal waveguide to transmit the transmit signal and a receive signal, wherein the diplexer comprises a first end and a second end, wherein a common port is provided at the first end. The diplexer furthermore comprises a waveguide arrangement that is coaxially disposed in the region of a second end of the signal waveguide. In addition, a cylindrical coupler section is provided that is disposed between the first and second ends of the signal waveguide, and connects the waveguide arrangement to the common signal waveguide. The invention is distinguished by the fact that the waveguide arrangement comprises a first circular waveguide and a second circular waveguide so as to create a first and second coaxial waveguide port. When the diplexer is operating, a first signal can propagate within the first circular waveguide, an inner conductor being disposed inside the first waveguide. A receive signal (subsequently also identified as a receive band) is conducted through the first circular waveguide. When the diplexer is operating, a second signal (transmit signal or transmit band) at a lower frequency than the first signal can propagate within a second circular waveguide, the second waveguide surrounding the first waveguide.

The invention furthermore provides a method for processing a signal fed into a diplexer provided according to the invention. In the method according to the invention, a TE11 mode is fed into the common port. A TM11 mode is excited in the signal waveguide and is superimposed with the TE11 mode in such a way that the total energy of the second signal (in the transmit band) flows into the second outer waveguide due to a constructive interference of outer field components and a destructive interference of inner field components, and that the total energy of the first signal (in the receive band) flows into the first inner waveguide due to a constructive of inner field components and a destructive interference of outer field components. When the first TM01 mode is fed in at the common port, the first signal (in the receive band) is converted into the TEM mode of the first waveguide. From the TE11 mode and the TM01 mode of the first signal (in the receive band), information is obtained by processing the modes for the purpose of aligning the reflector antenna.

The invention thus provides an approach where the transmit signal and the receive signal are separated, while simultaneously a transformation of the TM01 mode into the TEM mode is effected, thereby providing a tracking signal in the receive band for antenna alignment in addition to the communication signal. This is made possible by the use of an inner conductor that is disposed inside the first waveguide.

One advantage of this procedure is that the sum and difference signals required for tracking are coupled out under the same conditions, in particular, at the same temperature. This prevents phase errors caused by varying temperatures in the HF paths.

Another advantage is that the tracking signal is coupled out after the transmit signal and receive signal have been separated. As a result, disturbances of the transmit signal by a tracking mode coupler are prevented.

In contrast to the solutions known from prior art, no filters are required in the side arms to isolate the transmit signal. As a result, the feed system is essentially insensitive to uncertainties in manufacture.

The diplexer according to the invention is advantageously a coaxial diplexer. This results from the coaxial arrangement of the first circular waveguide that is surrounded by a second circular waveguide.

It is furthermore advantageous if the inner conductor is pin-shaped. The first waveguide and the inner conductor, in particular, terminate at the same or different levels.

Provision is made in another embodiment whereby the coupler section is designed as the first corrugated waveguide that includes a plurality of corrugations facing towards the inside of the signal waveguide that extend along an inner circumference. The first corrugated waveguide here adjoins the second end of the signal waveguide.

Provision is furthermore made whereby at least a certain segment of the second waveguide is designed as a corrugated waveguide that includes a plurality of corrugations facing towards the inside of the signal waveguide that extend along an inner circumference. The second corrugated waveguide preferably adjoins the coupler section or the second end of the signal waveguide.

Each of the corrugations of the first and/or the second corrugated waveguide are arranged so as to be equidistant from each other. In one specific embodiment, provision can be made whereby the spacing between respective corrugations of the first corrugated waveguide is different from the spacing of the respective corrugations of the second signal waveguide.

The diplexer according to the invention is furthermore distinguished by the fact that the second port (in the sideband) is coupled to a turnstile junction and to two 180° hybrid couplers, or to two coaxial side arm orthomode transducers, in order to generate dual linearly polarized signals. Alternatively, the second waveguide port (in the transmit band) is coupled to a polarizer, a turnstile junction, and two 180° hybrid couplers, or a turnstile junction, two 180° hybrid couplers, and a 90° hybrid coupler, in order to generate dual circular polarization.

In another embodiment, the first waveguide port (in the receive band) is coupled to a turnstile junction and three 180° hybrid couplers in order to generate linear polarization. Alternatively, the first waveguide port (in the receive band) is coupled to a turnstile junction, three 180° hybrid couplers, and a 90° hybrid coupler in order to generate circular polarization.

Other objects, advantages and novel features of the present invention will become apparent from the following detailed description of one or more preferred embodiments when considered in conjunction with the accompanying drawings.

BRIEF DESCRIPTION OF THE DRAWINGS

The following discussion describes the invention in more detail based on the figures. Here.

DETAILED DESCRIPTION OF THE DRAWINGS

Figure 1:
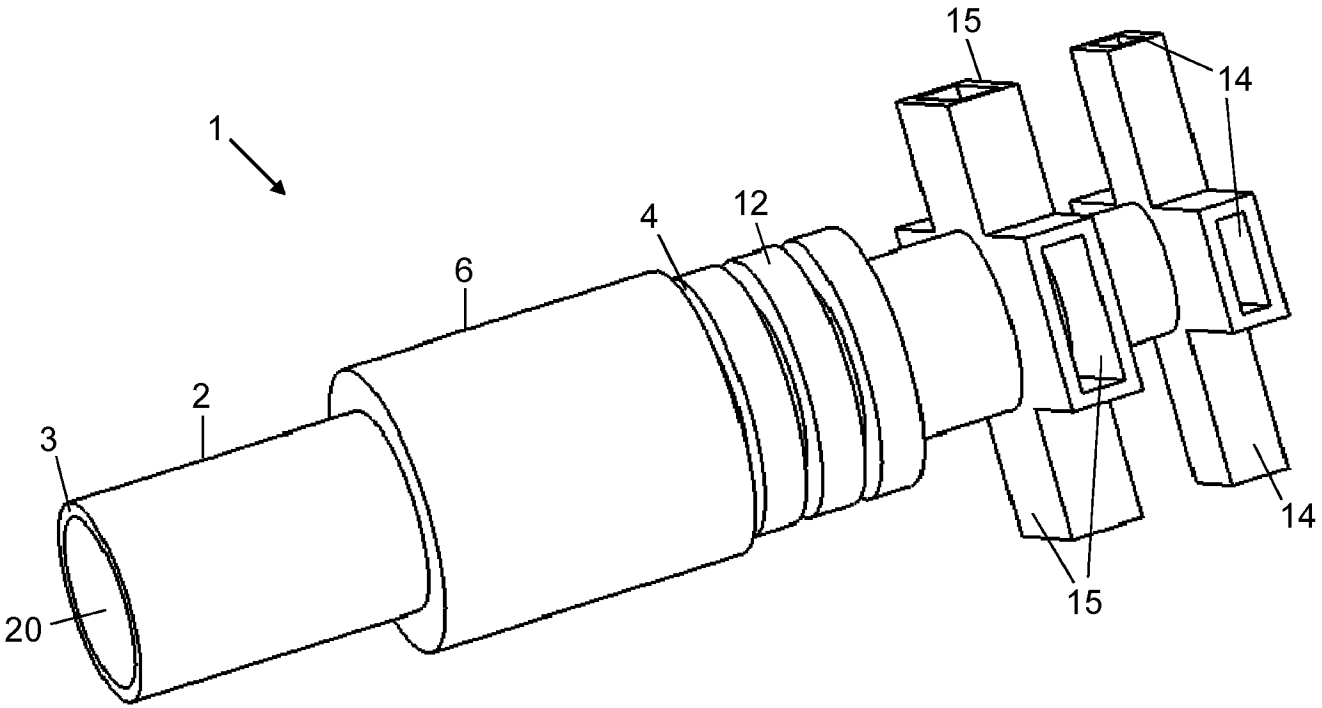
FIG. 1 is a perspective view illustrating a diplexer according to the invention.
Figure 2:
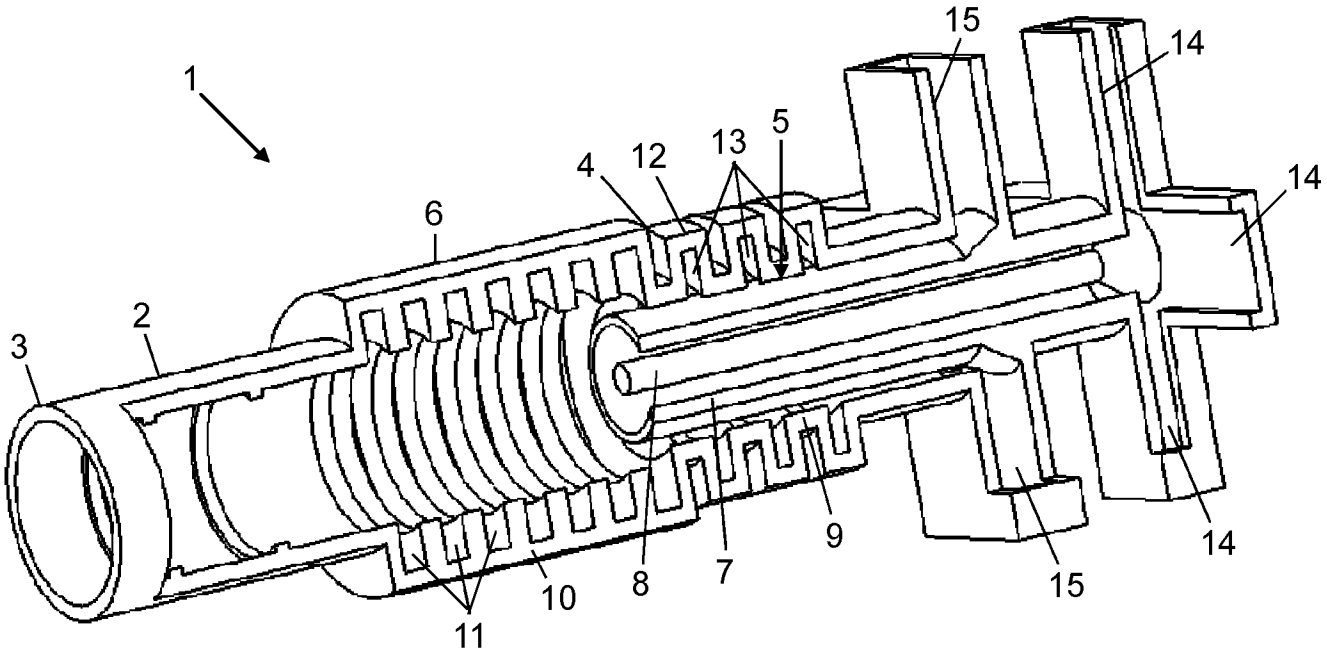
FIG. 2 is a perspective sectional view of a diplexer according to the invention.
Figure 3:
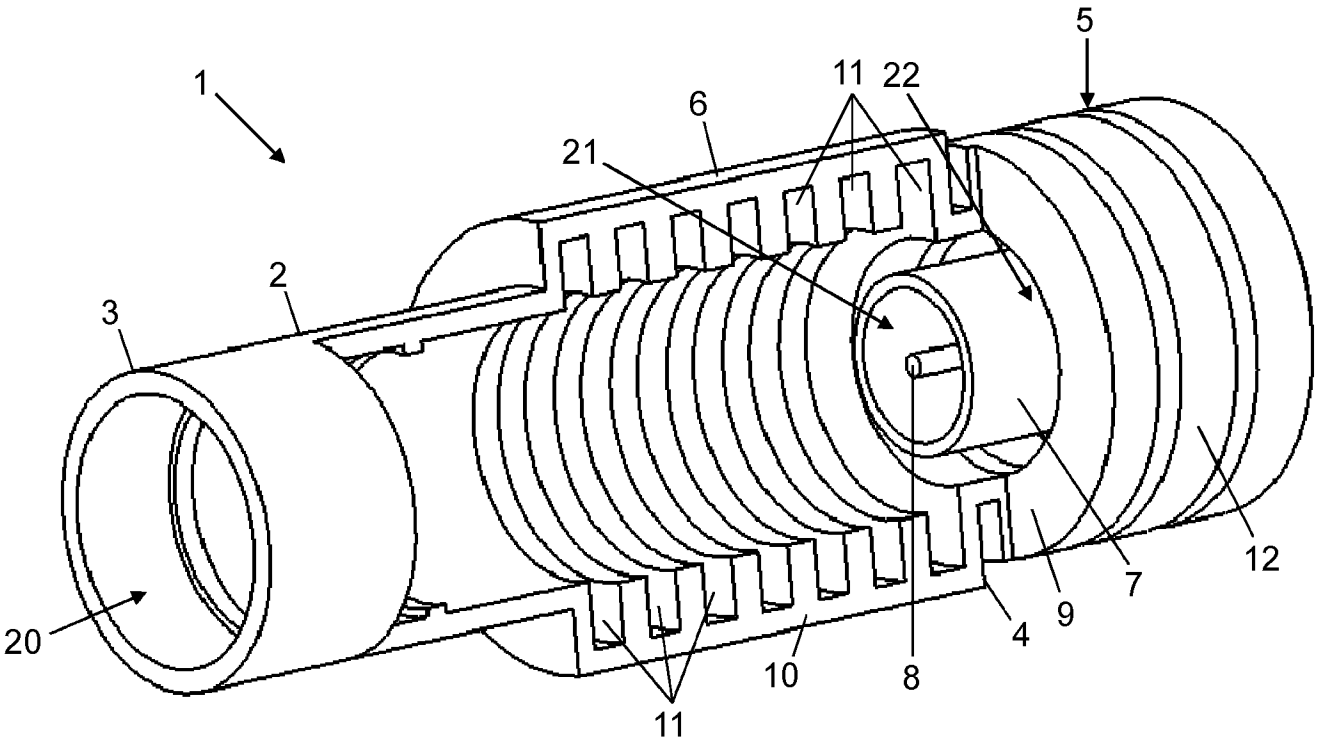
FIG. 3 shows a partial section of a diplexer according to the invention that illustrates the diplexer in a partial cutaway view.

FIGS. 1 through 3 illustrate a coaxial diplexer 1 according to the invention for a reflector antenna used to transmit microwave signals. Diplexer 1 comprises a common circular signal waveguide 2 to transmit a transmit signal and a receive signal. Signal waveguide 2 comprises a first end 3 and a second end 4. A common port 20 is provided at first end 3. A cylindrical coupler section 6 is disposed between first and second ends 3, 4, of signal waveguide 2, the cylindrical coupler section 6 adjoining second end 4. Cylindrical coupler section 6 is designed as the first corrugated waveguide 10. This waveguide includes a plurality of corrugations 11 extending in annular fashion along an inner circumference and facing towards the inside of signal waveguide 2. Corrugations 11 are spaced equidistantly relative to each other. Inside common signal waveguide 2, a waveguide arrangement 5 is connected thereto and adjoins second end 4 of signal waveguide 2. This arrangement is arranged coaxially relative to signal waveguide 2.

In order to provide first and second coaxial waveguide ports 21, 22, waveguide arrangement 5 comprises a first circular waveguide 7 in which a first signal can propagate in the receive band when the diplexer is operating, a pin-shaped inner conductor 8 being disposed inside first waveguide 7. In the embodiment, first waveguide 7 and inner conductor 8 terminate at the same level, although this is not absolutely essential. A second circular waveguide 9, which connects to the second end of signal waveguide 2, surrounds first waveguide 7. When the diplexer is operating, a second signal in the transmit band of lower frequency than the first signal in the receive band can propagate in second waveguide 9.

At least a segment of second waveguide 9 is designed as a second corrugated waveguide 12. The second corrugated waveguide immediately adjoins the second end of signal waveguide 2, or coupler section 6 or first corrugated waveguide 10. Facing towards the inside of the signal waveguide, second corrugated waveguide 12 has a plurality of corrugations 13 extending in annular fashion along an inner circumference. The corrugations of second corrugated waveguide 12 are disposed in equidistant fashion only by way of example. The spacing of corrugations 13 of second corrugated waveguide 12 here is wider than the spacing 5 of corrugations 11 of first corrugated waveguide 10.

Four transmit waveguides 15 or receive waveguides 14 each, which are disposed symmetrically relative to each other, are provided at the end of first waveguide 7 and second waveguide 9, which end faces away from the common signal waveguide. These waveguides are each of rectangular cross-section and are disposed orthogonally relative to a longitudinal or symmetrical axis of coaxial diplexer 1.

The common port 20 that is connected to a horn is fed with the TE11 mode. The TM11 mode is excited within the diplexer by appropriately sizing corrugations 11. The TM11 mode is superimposed with the TE11 mode in such a way that in the transmit band (i.e., a lower frequency band) the total energy flows into the outer coaxial waveguide (i.e., second waveguide 9) due to a constructive interference of the outer field components and a destructive interference of the inner field components. In the receive band (upper frequency band), the inner field components are superimposed with each other constructively, while the outer field components are superimposed with each other destructively. As a result, the total energy flows into the inner coaxial waveguide, i.e., first waveguide 7, in the interior of which inner conductor 8 is disposed.

In the receive band when the TM01 mode is fed in at the common signal waveguide, the energy is converted by the inner conductor into the TEM mode of the inner coaxial waveguide, i.e., of waveguide 7. Using signal processing, the requisite information for aligning the antenna can be obtained from the TE11 mode and the TM01 mode in the receive band.

The diplexer according to the invention makes it possible to use an appropriate network of hybrid couplers, of a turnstile junction, to split the received mode mixture into individual modes and optionally recombine these. This enables the received communication signal to be separated from the tracking modes, and a tracking signal to be generated that contains information about the magnitude and direction of the alignment deviation. As a result, direct correction of the antenna alignment is possible.

In order to generate dual linearly polarized signals, the coaxial diplexer is supplemented in the transmit band by a turnstile junction and two 180° hybrid couplers or by two coaxial side arm orthomode transducers (OMT).

With dual circular polarization, a polarizer, a turnstile junction, and two 180° hybrid couplers, or a turnstile junction, two 180° hybrid couplers, and a 90° hybrid coupler, can be provided in the transmit band.

In the receive band with linear polarization, a turnstile junction and three 180° hybrid couplers are used. A 90° hybrid coupler is added in the case of circular polarization.

These design variants are illustrated below in FIGS. 4 through 6.

Figure 4:
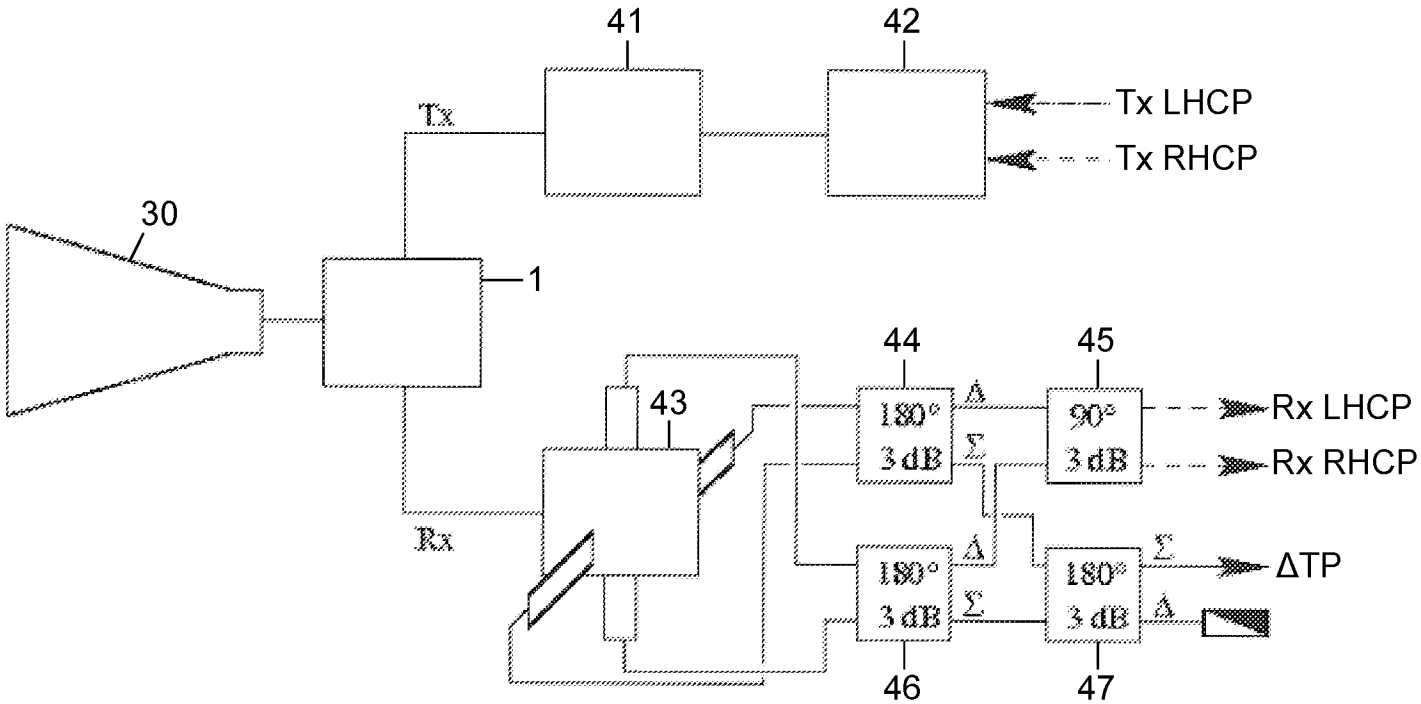
FIG. 4 is a schematic diagram for the use of the diplexer according to the invention based on a first design variant.
Figure 5:
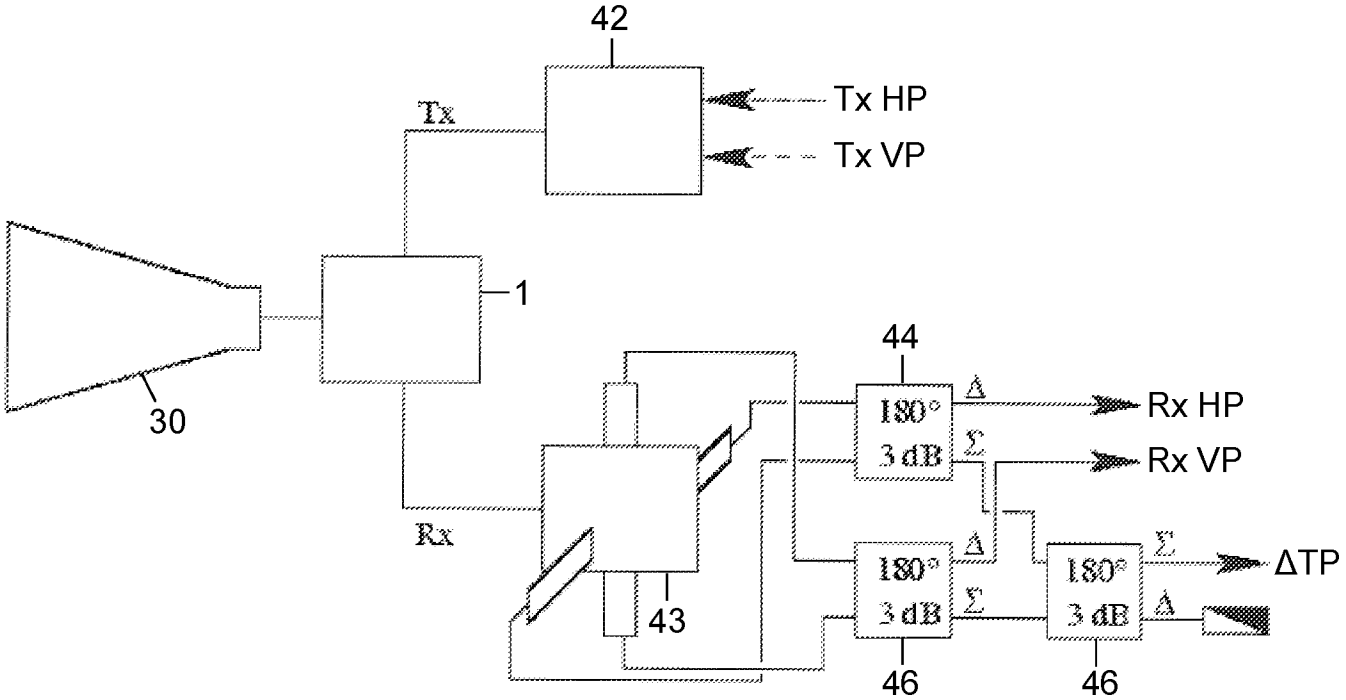
FIG. 5 is a schematic diagram for the use of the diplexer according to the invention based on a second design variant.
Figure 6:
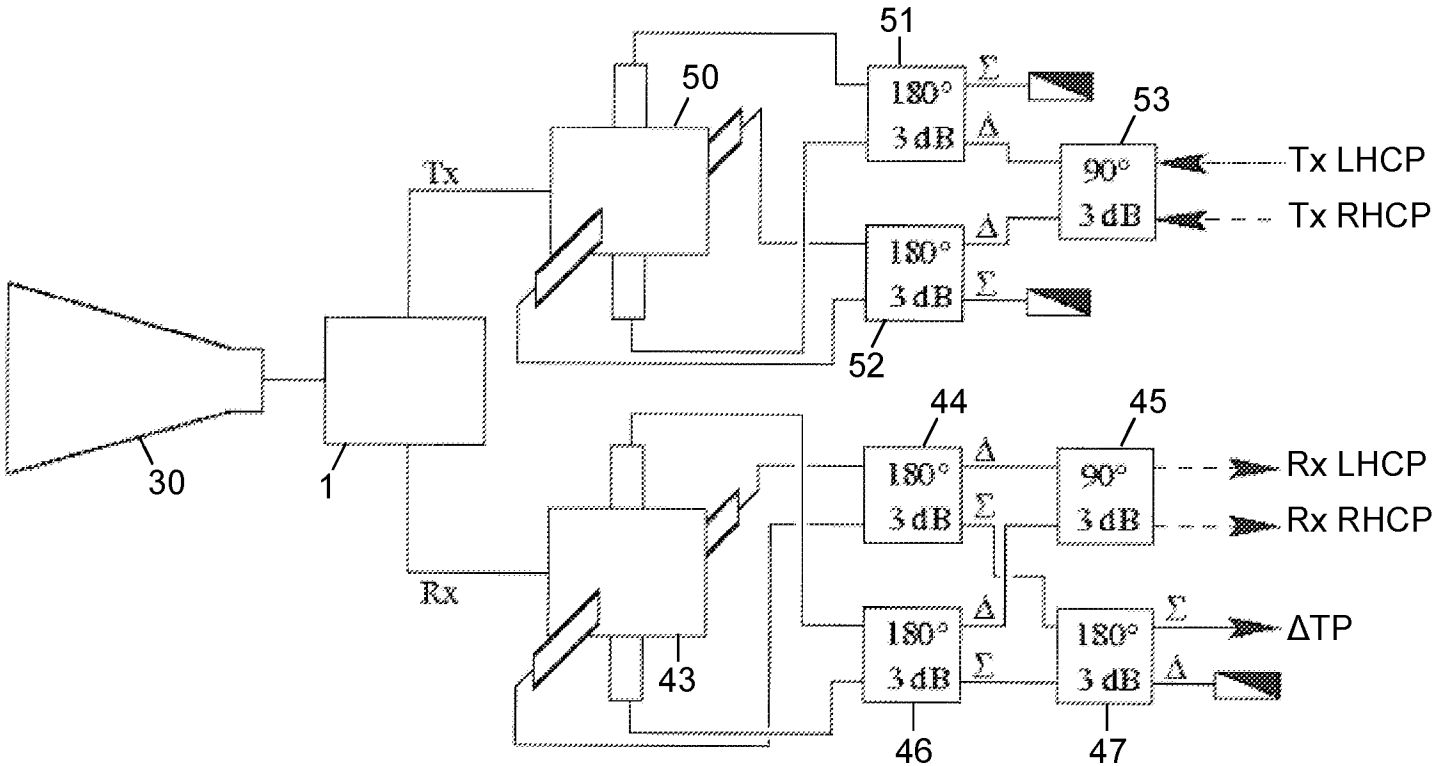
FIG. 6 is a schematic diagram for the use of the diplexer according to the invention based on a third design variant.

FIGS. 4 through 6 provide different schematic diagrams for the use of the diplexer according to the invention. In each case, a horn is identified by reference numeral 30, the horn being coupled to coaxial diplexer 1 according to the invention. A transmit path is identified by Tx, while a receive path is identified by Rx.

A coaxial polarizer 41 is connected to diplexer 1 in the transmit path of FIG. 4. In addition, a coaxial orthomode transducer 42 is connected to coaxial polarizer 41. The coaxial orthomode transducer receives user data to be transmitted Tx LHCP and Tx RHCP. A turnstile junction 43 is connected in the receive path Rx to coaxial diplexer 1. This junction is coupled to two 180° hybrid couplers 44, 46. A given difference signal Δ is fed to 90° hybrid coupler 45 at which received user data Rx LHCP and Rx RHCP are supplied. The sum signals (Σ) of the 180° hybrid couplers are fed to another 180° hybrid coupler 47 that generates a sum and difference signal (Σ, Δ). The sum signal (Σ) constitutes the tracking signal (ΔTP) required for correction of the antenna alignment.

Only one coaxial orthomode transducer 42 is coupled to diplexer 1 in the transmit path of FIG. 5. The diplexer receives user data to be transmitted Tx HP and Tx VP. Turnstile junction 43 is coupled on the output side to two 180° hybrid couplers 44, 46. These each generate a sum and difference signal (Σ, Δ). Received user data Rx HP and Rx VP can be obtained from the difference signals (Δ). The sum signal (Σ) are fed to another 180° hybrid coupler 47, the tracking information (ΔTP) being obtained from this generated sum signal (Σ).

In the embodiment of FIG. 6, receive path Rx is provided analogously to the receive path shown in FIG. 4. A coaxial turnstile junction 50 is also provided in transmit path Tx, this junction being connected to diplexer 1. Turnstile junction 50 is coupled to two 180° hybrid couplers 51, 52. A 90° hybrid coupler 53, to which user data to be transmitted Tx LHCP and Tx RHCP are fed, is coupled to difference inputs (Δ) of 180° hybrid couplers 51, 52.

The receive network of the design variants shown at the same time functions to couple out the TEM mode with the tracking information. The closely adjacent out-coupling of the TE11 mode in the receive band and of the TEM mode, in particular, the similar thermal conditions, produce the result that the automatic antenna alignment based on tracking information is very accurate and temperature-stable.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A diplexer for a reflector antenna for transmitting microwave signals, comprising:

a common circular signal waveguide to transmit and receive signals, the waveguide comprising a first end and a second end, wherein a common port is provided at the first end;

a waveguide arrangement disposed coaxially relative to the common circular signal waveguide in a region of the second end of the common circular signal waveguide;

a cylindrical coupler section disposed between the first and second ends of the common circular signal waveguide and connecting the waveguide arrangement to the common circular signal waveguide, wherein the cylindrical coupler section has an outer surface with a diameter that is greater than a diameter of an outer surface of the common circular signal waveguide, wherein first and second coaxial waveguide ports are created by the waveguide arrangement comprising a first circular waveguide that propagates a first signal when the diplexer is operating, wherein an inner conductor is disposed inside the first circular waveguide, and a second circular waveguide that propagates a second signal at a lower frequency than the first signal when the diplexer is operating, wherein the second waveguide surrounds the first waveguide, wherein the inner conductor is pin-shaped.

2. The diplexer according to claim 1, wherein the diplexer is a coaxial diplexer.

3. The diplexer according to claim 1, wherein the first circular waveguide and the inner conductor terminate at a same level.

4. The diplexer according to claim 1, wherein the first circular waveguide and the inner conductor terminate at a different level.

5. The diplexer according to claim 1, wherein the cylindrical coupler section is a first corrugated waveguide having a plurality of corrugations extending in an annular fashion along an inner circumference and facing towards the inside of the common circular signal waveguide.

6. The diplexer according to claim 5, wherein the first corrugated waveguide adjoins the second end of the common circular signal waveguide.

7. The diplexer according to claim 5, wherein the plurality of corrugations of the first corrugated waveguide are each disposed equidistant from each other.

8. The diplexer according to claim 1, wherein at least a segment of the second circular waveguide is a second corrugated waveguide having a plurality of corrugations extending in an annular fashion along an inner circumference and facing towards the inside of the common circular signal waveguide.

9. The diplexer according to claim 8, wherein the second corrugated waveguide adjoins the cylindrical coupler section or the second end of the common circular signal waveguide.

10. The diplexer according to claim 8, wherein the plurality of corrugations of the second corrugated waveguide are each disposed equidistant from each other.

11. The diplexer according to claim 1, wherein in order to generate dual linearly polarized signals in a transmit band the second waveguide port is coupled to a turnstile junction and two 180° hybrid couplers, or two coaxial side arm orthomode transducers.

12. The diplexer according to claim 1, wherein in order to generate dual circular polarization in a transmit band the second coaxial waveguide port is coupled to a polarizer, a turnstile junction, and two 180° hybrid couplers, or a turnstile junction, two 180° hybrid couplers, and a 90° hybrid coupler.

13. The diplexer according to claim 1, wherein in order to generate linear polarization in a receive band the first coaxial waveguide port is coupled to a turnstile junction and three 180° hybrid couplers.

14. The diplexer according to claim 1, wherein in order to generate circular polarization in a receive band the first coaxial waveguide port is coupled to a turnstile junction, three 180° hybrid couplers, and a 90° hybrid coupler.

15. A method of processing a signal fed into a diplexer, comprising:

feeding a TE11 mode into a common port;

exciting a TM11 mode in a signal waveguide and superimposing the TM11 mode with the TE11 mode in such a way that a total energy of a signal in a transmit band flows into a second outer waveguide due to a constructive interference of outer field components and a destructive interference of inner field components; and a total energy of a first signal in a receive band flows into a first inner coaxial waveguide due to a constructive interference of inner field components and a destructive interference of outer field components;

feeding in a TM01 mode at the common port and converting, by an inner conductor, a second signal in the receive band into a TEM mode; and processing the signal in the receive band from the TE11 mode and the signal in the receive band from the TM01 mode in order to align a reflector antenna.

* * * * *